United States Patent [19]

Baldorossi et al.

[11] 4,026,561

[45] May 31, 1977

[54] GOLF GAME APPARATUS

[76] Inventors: Blanche N. Baldorossi; Raymond F. Baldorossi, both of 3702 Meadowbrook Ave., Orlando, Fla. 32808

[22] Filed: May 1, 1975

[21] Appl. No.: 573,773

Related U.S. Application Data

[63] Continuation-in-part of Ser. No. 461,511, April 16, 1974, abandoned.

[52] U.S. Cl. ..... 273/193 R; 273/199 R; 273/177 A; 273/77 A; 273/176 AB

[51] Int. Cl.[2] ..... A63B 69/36; A63B 53/04

[58] Field of Search ... 273/DIG. 8, 178 A, 176 AA, 273/176 AB, 58 A, 193 R, 193 A, 193 B, 199 R, 199 A, 194 R, 77 A, 167 R, 77 R, 35 R

[56] References Cited

UNITED STATES PATENTS

| | | | |
|---|---|---|---|
| 1,152,313 | 8/1915 | Hammond | 273/176 AA |
| 1,513,917 | 11/1924 | Long | 273/178 A |
| 3,427,030 | 2/1969 | Ward | 273/176 AB |
| 3,515,389 | 6/1970 | Wolfe | 273/58 A X |
| 3,518,786 | 7/1970 | Holtvoigt | 273/DIG. 8 |

*Primary Examiner*—George J. Marlo

*Attorney, Agent, or Firm*—Julian C. Renfro

[57] ABSTRACT

A game playable in an area only approximately one-fifteenth of the area of a regulation golf course, with the length of play being approximately one-fifth the length of a regulation 18-hole golf course, comprising a large ball and a set of golfing clubs having heads of large size. The ball has a small weight-to-volume ratio in that it weighs approximately 2 ounces and is approximately 5 inches in diameter, and typically is of lightweight foam construction. Each of the clubs of said set of clubs has a head having a weight very similar to that of a regulation golf club, and a face inclined at approximately the angle of the corresponding regulation golf club. Each of the faces, however, have a surface area approximately 2.8 times larger than the faces of regulation golf clubs, with the relationship between the ball and each of the clubs being such as to permit a form of play action very much like the play action of regulation golf in that a player will be able to utilize an unrestricted swing in hitting said ball and obtain a feel very similar to that received when he swings a regulation golf club and hits a regulation golf ball. Desirably, however, the ball in this instance travels for a comparatively short distance because of its small weight-to-volume ratio.

3 Claims, 19 Drawing Figures

| CLUB TYPE | GAME TYPE | CLUB LOFT ANGLE IN DEGREES | LENGTH IN INCHES | CLUB FACE AREA IN SQ INCHES | CLUB FACE AREA RATIO | WEIGHT IN OUNCES | LIE ANGLE IN DEGREES | RANGE OF AVERAGE DISTANCE IN YARDS |
|---|---|---|---|---|---|---|---|---|
| PUTTER | SOFTGOLF | 5 | 34.5 | 16.0 | 4.2/1 | 18.0 | 78 | —— |
| | REGULAR | 5 | 34.5 | 3.8 | | 18.0 | 78 | —— |
| 1 | SOFTGOLF | 19 | 39.5 | 12.4 | 3.1/1 | 14.0 | 56 | 40–55 |
| | REGULAR | 19 | 39.5 | 4.0 | | 14.0 | 56 | 150–250 |
| 4 | SOFTGOLF | 31 | 38 | 13.8 | 3.0/1 | 15.0 | 59 | 30–45 |
| | REGULAR | 31 | 38 | 4.6 | | 15.0 | 59 | 110–190 |
| 8 | SOFTGOLF | 43 | 36 | 14.2 | 2.9/1 | 16.0 | 63 | 20–35 |
| | REGULAR | 43 | 36 | 4.9 | | 16.0 | 63 | 75–145 |
| WEDGE | SOFTGOLF | 55 | 35.5 | 15.4 | 2.8/1 | 17.0 | 64 | 15–25 |
| | REGULAR | 55 | 35.5 | 5.5 | | 17.0 | 64 | 60–120 |

FIGURE 13

GOLF GAME APPARATUS

REFERENCE TO EARLIER INVENTION

This is a continuation-in-part of our copending application Ser. No. 461,511, filed Apr. 16, 1974 and entitled "SOFTGOLF," now abandoned.

BACKGROUND OF THE INVENTION

Many generations of sportsmen and sportswomen have enjoyed the game of golf which, in the classic instance, is played on an 18-hole course having a playing length of several thousand yards. The approximate area of an average 18 hole regulation golf course is 120 acres. Most golfers enjoy the long fairways and the broad greens and look forward to each next occasion when they can travel to the golf course and indulge in this fine game.

However, due to increased population, rising real estate prices, and higher taxes, as well as other factors including inflation, it is no longer a simple matter to raise the substantial amount of funds necessary in order for the establishment and construction of a golf course of regulation size.

Because a golf course typically requires so much acreage, and because of the land values and municipal taxes involved, it is necessary to create golf courses that are further and further from residential areas. This of course means that a golfer must travel for great distances in many instances in order to pursue this game. Also, he or she must be willing to pay large membership fees and substantial yearly fees if he or she is to belong to a typical golf club.

A number of substitutes for the regulation game of golf have been proposed, but none of these has ever achieved popularity.

SUMMARY OF THIS INVENTION

In accordance with this invention, we have evolved a new game we call "softgolf" which may be played in much the manner of regulation golf but in locations where considerable acreage is not available. Because we utilize a ball having a weight closely similar to the weight of a regulation golf ball, but which has a diameter of approximately 5 inches, our ball has a small weight-to-size ratio. Because of the small weight-to-size ratio and the elasticity of the ball material, the coefficient of restitution is greatly affected. We have found through extensive experiments that our ball will travel only one-fourth or one-fifth the distance that the regulation golf ball would have traveled had it been struck with an equivalent swing by a corresponding regulation golf club.

Not only does the softgolf ball in accordance with this invention travel for comparatively short distances, but also, because of the type materials used and its small weight-to-size ratio, it will not cause harm or damage, which of course is another way of saying that even if the ball in flight strikes a person, it will not have the possible lethal effect that a regulation golf ball would have had.

Because we have carefully sized the ball while retaining a proper weight thereof, and proportionally sized up the face of each of the clubs of the set of clubs we use, we have preserved the "feel" that the golfer normally obtains when he swings a regulation golf club and hits a regulation golf ball. In other words, we have made it possible for a golfer having only a limited space available, to nevertheless keep up his game and be able to hit balls with full energy swings without having to travel considerable distances in order to find space sufficient for hitting conventional golf balls.

The game we have developed is realistic in many aspects, for we envision a set of clubs closely corresponding to regulation golf clubs insofar as length, weight and face angle are concerned, with the principal departure involving an increase in face area so as best to contact the large ball we use. The golfer can practice his driving, putting and other requisite skills of the golfer in the privacy of his home or yard, or in a nearby vacant lot, and thus effectively keep in practice without wondering if he will cause damage or lose the ball.

As should be obvious, the game we have devised lends itself as a sport played by the individual, or by groups or families, and various contests and competitions may be established in the form of leagues, tournaments, and other challenges. Our game also may form the basis for a business franchise, operated separately or in conjunction with campgrounds, mobile home parks, hotels, recreation parks, resorts and the like, with all of this being able to be accomplished at but a fraction of the cost of a regulation golf course. For example, a nine hole course in accordance with this invention can be accommodated in approximately 5 acres, and an eighteen hole course in approximately 8 acres.

It is therefore a principal object of this invention to provide a golf game that is closely realistic to regulation golf, but which is entirely non-hazardous, enabling it to be played in a city or in other municipal area where space is limited.

It is another object of our invention to provide a novel yet realistic golf game utilizing a ball having a comparatively low weight-to-size ratio, which advantageously will travel only about one-fourth or one-fifth the distance of a regulation golf ball when equivalent swings are involved, thus enabling the full enjoyment of the game to be realized in appoximately one-fourth the time span of regulation golf.

It is yet another object of our invention to provide a novel game enabling a golfer to keep up his golf game in a very effective manner by daily or mid-week practice utilizing a large size ball with regulation weight, with such being able to be accomplished with the confidence that the swing as well as other characteristics of this game are closely comparable to regulation golf.

It is still another object of this invention to provide a novel and highly enjoyable game that can be played on a course requiring only a fraction of the acreage of the regulation golf course.

It is yet still another object of our invention to provide a softgolf game involving multiple clubs comparable to regulation clubs, such that the avid golfer can practice long hitting even in urban areas, and can practice his putting skills as well.

It is another object to provide a game lending itself to adoption by groups, institutions, municipalities or private individuals, inasmuch as an entire course provided in accordance with this invention occupies but a fraction of the area and involves but a fraction of the cost of a conventional course.

It is yet another object of our invention to provide a novel and highly effective portable ball trap.

DESCRIPTION OF THE DRAWINGS

FIGS. 5A through 7A are face views of the same clubs shown in FIGS. 5 through 7 respectively;

FIG. 13 is a chart involving a putter, Nos. 1, 4 and 8 irons, and a wedge in accordance with softgolf criteria, with this in each instance being set forth adjacent the corresponding regulation club in order to show identicalness of loft angle, lie angle, club length and weight for corresponding clubs, but contrasting the club face areas and the range of average distance reached when using our clubs;

GENERAL DESCRIPTION

Figure 1:
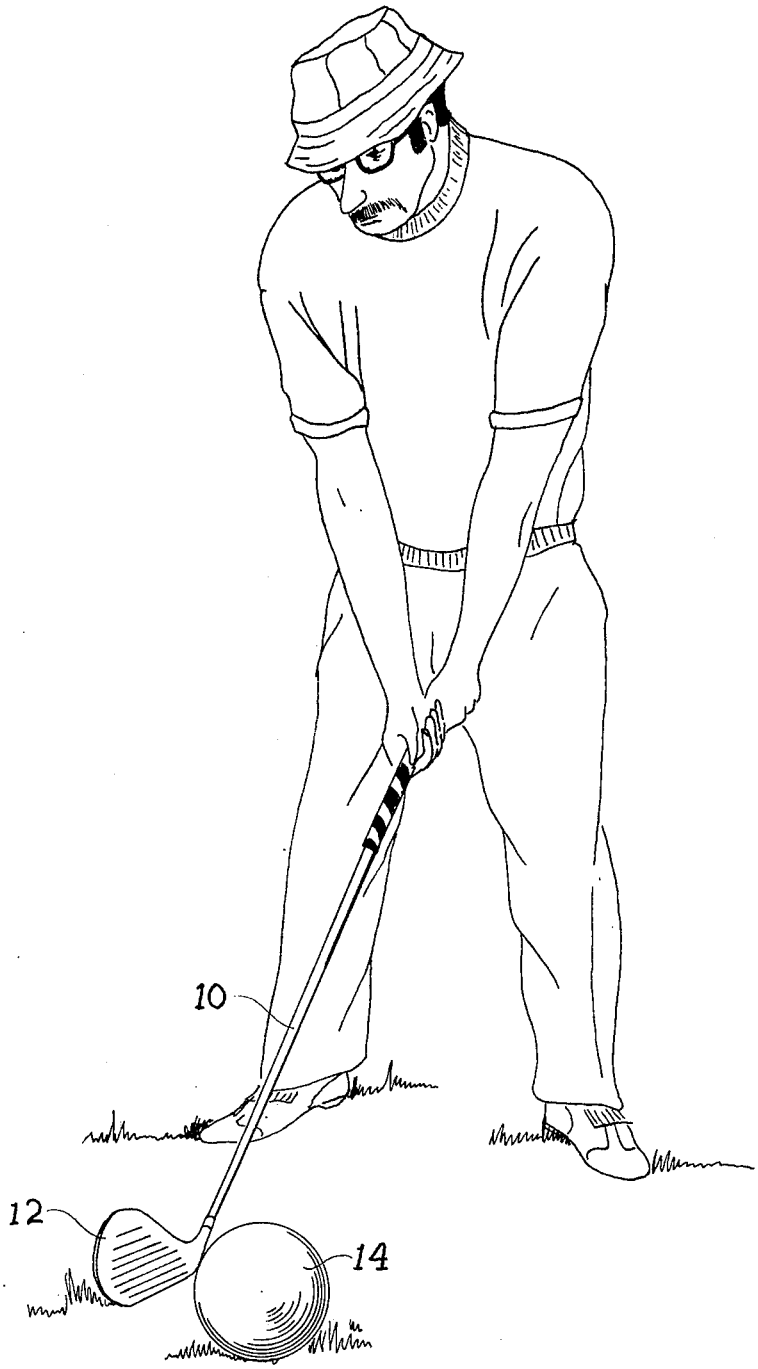
FIG. 1 shows a golfer holding a club and addressing a ball in accordance with this invention, with this figure revealing to some extent the increase in accordance with this invention of the size of the ball and club face over that of regulation golf.

Turning to FIG. 1, it will there be seen we have shown a golfer in a typical golfing stance, holding a golf club 10 in accordance with our invention. It is to be noted that the club head 12 is of a size that is noticeably larger than that of the corresponding regulation club, with this enlarged size being appropriate for contacting the ball 14 we use, which is of considerably larger diameter than the diameter of a regulation golf ball.

As will be explained at length hereinafter, the club head 12 and the ball 14 are of a weight such that the golfer will obtain a "feel" almost identical to that when a golfer swings a regulation club and hits a regulation golf ball. However, the ball 14 in accordance with this invention is spherical, weighing approximately 2.2 ounces and having a diameter of approximately 4.8 inches, so it has a weight-to-size ratio of about 0.458. However, we prefer to refer to the ball in terms of its weight-to-volume ratio, as will be seen hereinafter, with this ratio being approximately one seventeenth of the weight-to-volume ratio of a regulation golf ball. As a result, our ball will not travel nearly as far as a regulation ball for an equivalent swing by the golfer, and as a matter of fact, the ball in accordance with this invention typically only travels about one-fourth as far. Although we prefer the weight and size specified, we are not to be limited to these, and as explained hereinafter, there can be some variation in diameter and weight of the balls we use.

Figure 2:
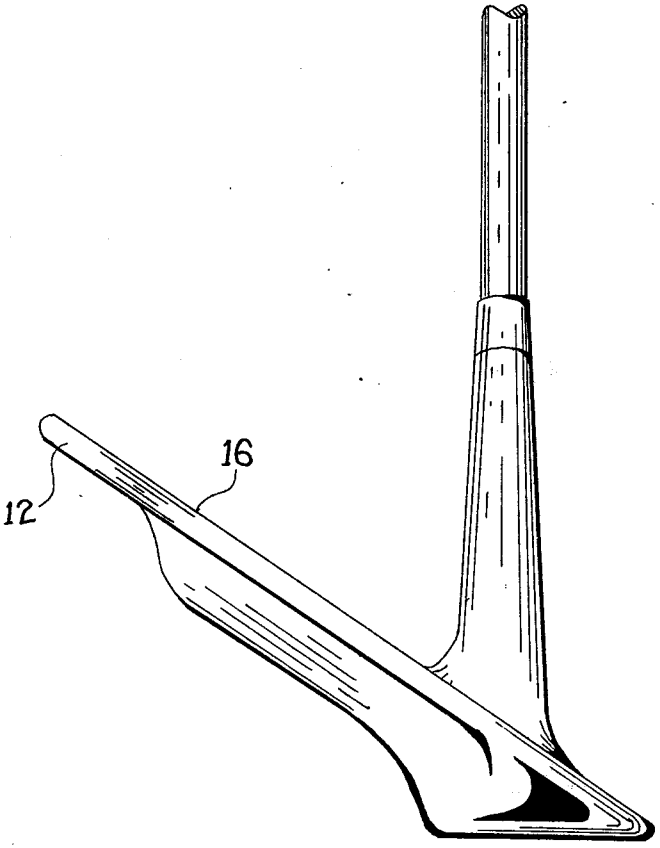
FIG. 2 is a view to full scale looking into the front of a typical loft club in accordance with this invention.

Turning to FIG. 2, we have there provided a full size showing of the head 12 of a typical club in accordance with this invention, with the face 16 of the club being disposed at approximately 55°. In this regard, the club shown in FIG. 2 corresponds to a wedge club of regulation golf. However, the area of the face 16 in accordance with this invention is approximately 15.4 square inches, or approximately 2.8 times the area of the face of the corresponding regulation club. It will be pointed out in connection with FIG. 13 how the clubs in accordance with this invention have in each instance the same loft angle as the corresponding regulation club, as well as the same weight and total length of the shaft and head, but have a much larger club face area. We prefer to use club heads of aluminum alloy, but are not to be limited to this material.

Figure 3:
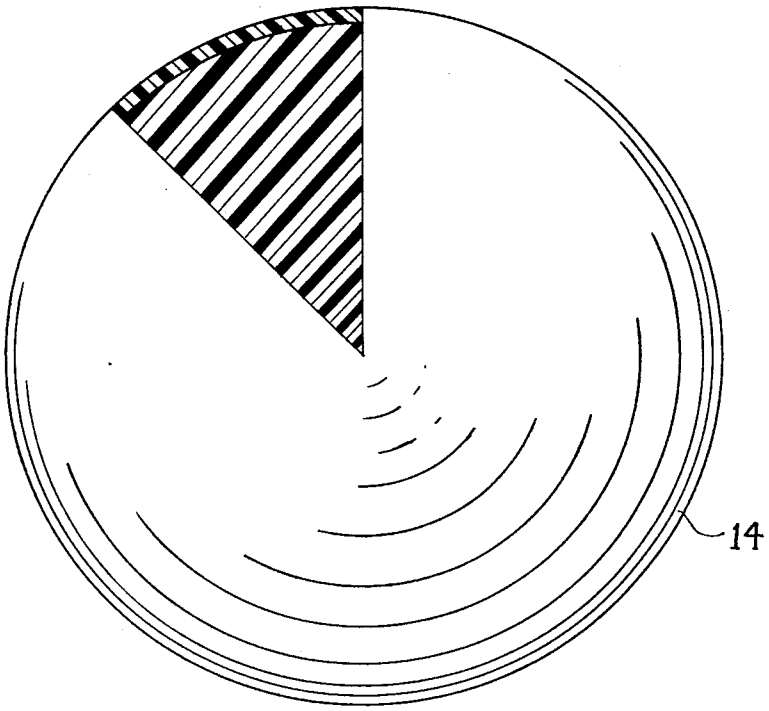
FIG. 3 is a full scale view of a preferred embodiment of a ball in accordance with our softgolf game, with the ball in this instance being constructed of closed cell lightweight foam, over which a skin of tough, wear-resistant flexible material is provided.

Turning to FIG. 3, it is there to be seen that we have shown a first embodiment of a ball 14 in accordance with this invention, with a portion of the ball being cut away so as to reveal internal construction. In a typical instance, a ball along the lines of that shown in FIG. 3 has an internal portion of closed cell flexible foam of a density of approximately 3 lbs. to 4 lbs. per cubic foot. Obviously, many types of lightweight foams could not withstand direct, forceful contact with the clubs in accordance with this invention, so we typically have a covering 20 that is molded in place. This may be either an integral formed skin or a thin tough skin formed as a result of an applied coating.

A modified form of a ball in accordance with the embodiment of FIG. 3 may be of a closed cell flexible foam of a density of 2 to 3 lbs. per cubic foot, molded with a thick integral formed skin, or alternatively equipped with a thick skin coating that has been applied. In any event, the ball normally has a diameter of 4.80 inches, but we are not to be limited to this, for the ball diameter could be as great as 5.0 inches or as small as 4.2 inches.

The ball 14 in accordance with this invention normally has a weight of 2.2 ounces, but we are not to be limited to this weight, for the ball can have a weight as great as 2.5 ounces, or as small as 2.0 ounces.

Based on the preferred or nominal weight of 2.2 ounces and diameter of 4.80 inches, our ball has a nominal weight-to-volume ratio of 0.038. This value is obtained by dividing 2.2 ounces by 57.906 cubic inches, latter being the volume corresponding to this diameter. As should be apparent, this weight-to-volume ratio is quite small when compared to the weight-to-volume ratio of a regulation golf ball.

Inasmuch as a regulation golf ball has a weight of 1.62 ounces and a diameter of 1.68 inches, its weight-to-volume ratio is 0.6525, this value being obtained by dividing 1.62 by 2.48 cubic inches, the volume corresponding to a diameter of 1.68 inches.

Dividing the weight-to-volume ratio of the regulation golf ball by the weight-to-volume ratio of the softgolf ball reveals that the weight-to-volume ratio of the regulation golf ball is seventeen times greater than the weight-to-volume ratio of our novel ball, thus providing a very basic reason for the regulation golf ball traveling four or so times the distance of our ball for equivalent swings of respective clubs.

The weight-to-volume ratio of 0.038 is given by way of example, and also by way of comparison with the weight-to-volume ratio of a regulation golf ball. Actually, the ratio for a 5 inch diameter ball weighing 2 ounces would be 0.0305, whereas the ratio for a 4.2 inch diameter ball weighing 2.5 ounces would be 0.0644.

Figure 4A:
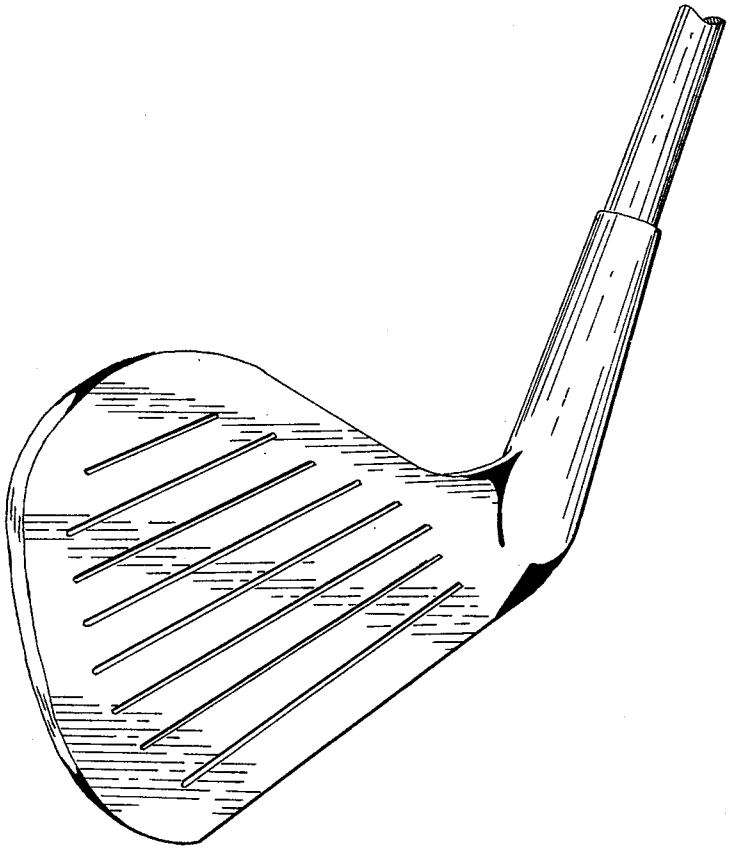
FIG. 4A is an isometric view of the club whose front edge is illustrated in FIG. 4.
Figure 4:
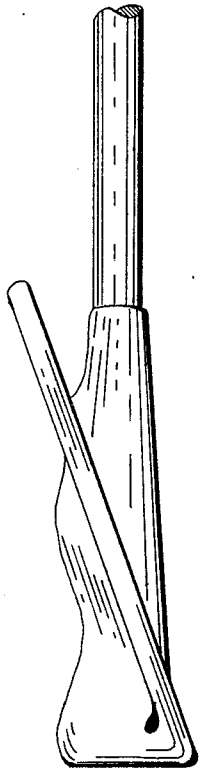
FIG. 4 is a view to one-half scale, looking into the front of a club having substantially less loft angle than the club shown in FIG. 2.
Figure 5:
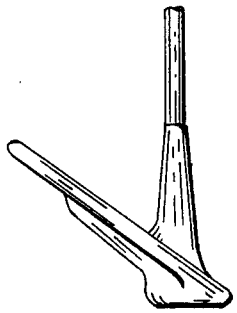
FIGS. 5, 6 and 7 are illustrative of three more loft clubs in accordance with this invention, each being shown to one-half scale, and each finding a counterpart in a regulation golf club set.
Figure 5A:
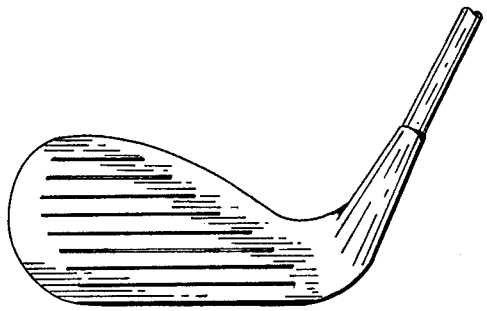
Figure 6:
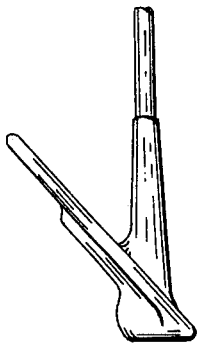
Figure 6A:
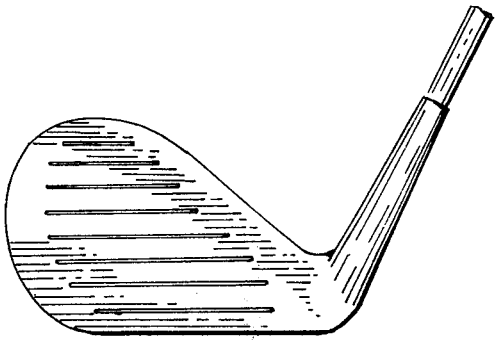
Figure 7:
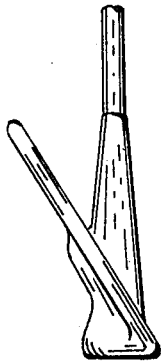
Figure 7A:
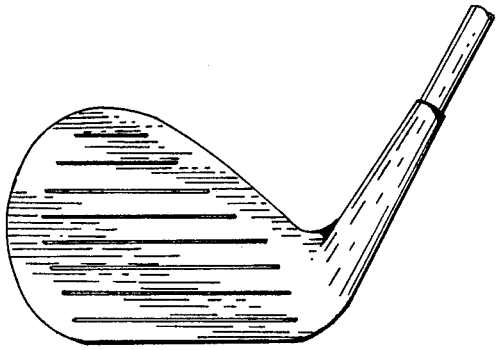
Figure 8:
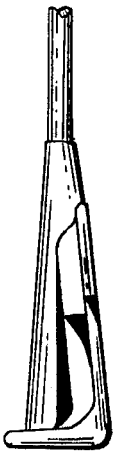
FIG. 8 is a front view of a putter club in accordance with this invention.
Figure 8A:
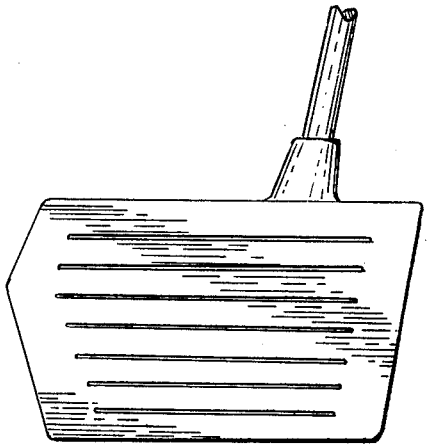
FIG. 8A is a side view of the same club.

Turning to FIGS. 4 through 7, it is there to be seen that we have shown scale drawings looking into the front edge of several loft clubs in accordance with this invention. The club in FIG. 4 is a No. 1 club, with FIG. 4A showing an isometric view of the club face. Somewhat similarly, in FIGS. 5, 6 and 7 we have shown front edge views of other loft clubs in accordance with this invention, with FIG. 5A being a view of the appearance of the club face of the club shown in FIG. 5; FIG. 6A being a view of the appearance of the club face of the club shown in FIG. 6; and FIG. 7A being a view of the appearance of the club face of the club shown in FIG. 7. FIGS. 8 and 8A of course represent a putter in accordance with this invention. It is to be realized in each instance that these clubs correspond to regulation golf clubs from the standpoint of loft angle, lie angle, length and weight, although they have a face area typically in the vicinity of 2.8 to 4.2 times the face area of the corresponding regulation club. It is also to be realized that we are not to be restricted to club sets involving only the clubs mentioned herein, for obviously other clubs could be provided in consonance with this invention.

Figure 9:
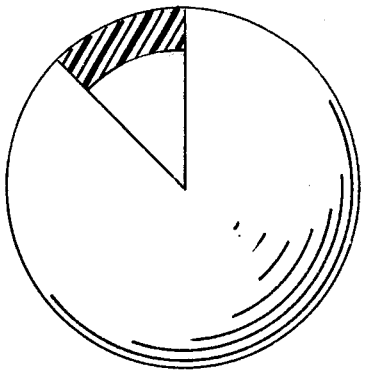
FIG. 9 is another embodiment of a softgolf ball in accordance with this invention, in this instance involving a ball having a thick outer wall and a hollow interior, with closed cell medium density foam being utilized in its construction.

Turning to FIG. 9, it is to be seen that balls meeting the weight and diameter criteria we have chosen do not necessarily have a solid core. As shown in this Figure, the ball may have a hollow interior, but utilize a comparatively thick shell or outer covering portion. We have found that we can maintain the desired weight by utilizing closed cell foam of approximately 17 pounds per cubic foot up to approximately 36 pounds per cubic foot.

Figure 9A:
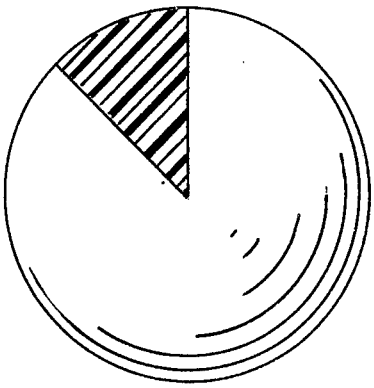
FIG. 9A is still another embodiment of a softgolf ball, in this instance being a ball entirely constructed of closed cell flexible foam and having an integral skin foamed in place.

Turning to FIG. 9A, it is also to be seen that by utilizing closed cell foam of particularly tough construction, it is possible to get by without having a discrete covering on the ball. Other examples of balls in accordance with our invention may utilize an interior portion of cork or other light material, the external portion of which has been covered with a smooth tough covering of plastic or the like.

Figure 10:
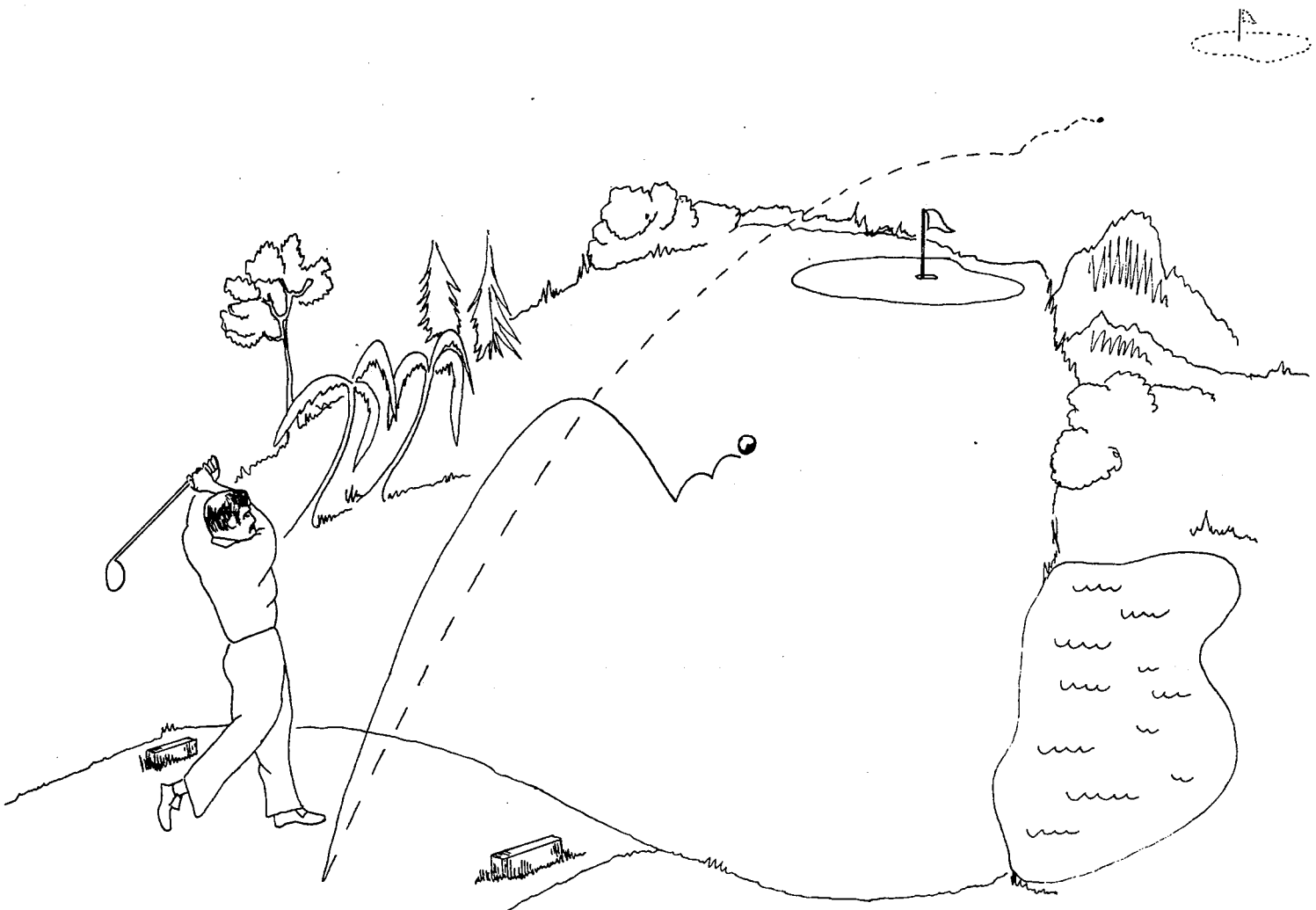
FIG. 10 typifies a golfer teeing off on a softgolf course, in this instance involving a par 4 playing hole with a distance of 65 to 85 yards, with the solid line showing the travel of a softgolf ball, and the dashed lines being utilized to show the distance that would have been traveled by a regulation golf ball when hit with the same force by a golfer using a regulation golf club.

FIG. 10 reveals a golfer utilizing a golf course constructed in accordance with the present invention, in which the fairway is of a much smaller size than the conventional fairway, with the green likewise being much closer than the green of a conventional golf course. This figure portrays a par 4 soft-golf playing hole, with a distance of 65 to 85 yards being involved, whereas the green of the conventional course is to be seen in phantom lines in the far distance, normally 290 yards to 425 yards.

In FIG. 10, the golfer driving a softgolf ball in accordance with this invention has utilized an unrestricted swing, with the solid line representation revealing a flight distance of say 15 to 55 yards. Had he been using a regulation club and regulation ball, his drive would have carried say 60 to 250 yards, as depicted by the dashed lines.

Quite obviously, the city dweller can obtain all of the benefits of the sport and exercise associated with golf merely by utilizing equipment in accordance with this invention, inasmuch as the ball does not travel, for an equivalent swing, nearly as far as the regulation ball would have traveled. This of course makes it possible for softgolf to be played quite effectively in a much more confined area than regulation golf would have required.

Figure 11:
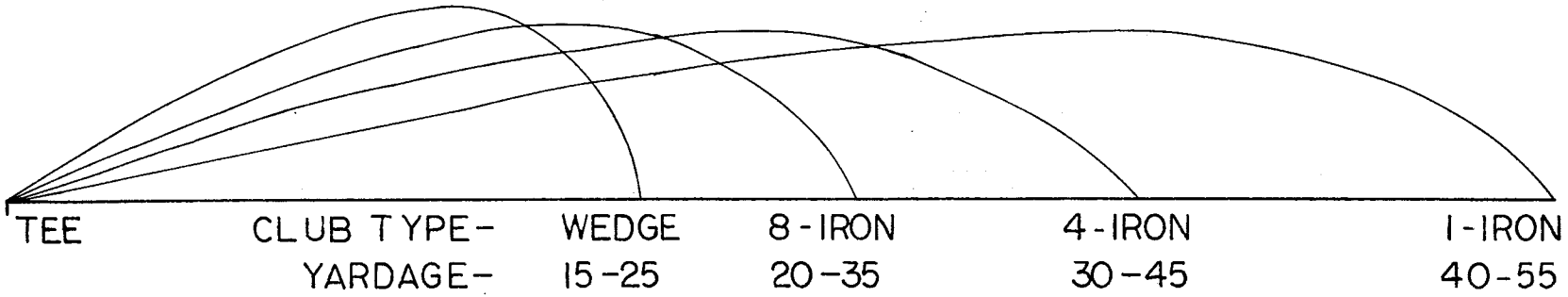
FIG. 11 is a schematic presentation of the trajectories associated with a softgolf ball hit using various designated softgolf clubs in accordance with this invention.

Turning to FIG. 11 it is to be seen that we have shown typical distances from the tee that have been reached by the golfer utilizing a softgolf ball in accordance with this invention, with various clubs in accordance with this invention having been used. It is to be kept in mind that the golfer utilizing our equipment obtains almost the same feel as he or she would have obtained using regulation equipment, but the weight-to-volume ratio represented by the softgolf balls we use prevents them from traveling more than approximately one-fourth the distance than the regulation ball struck by a regulation club would have traveled.

Figure 12:
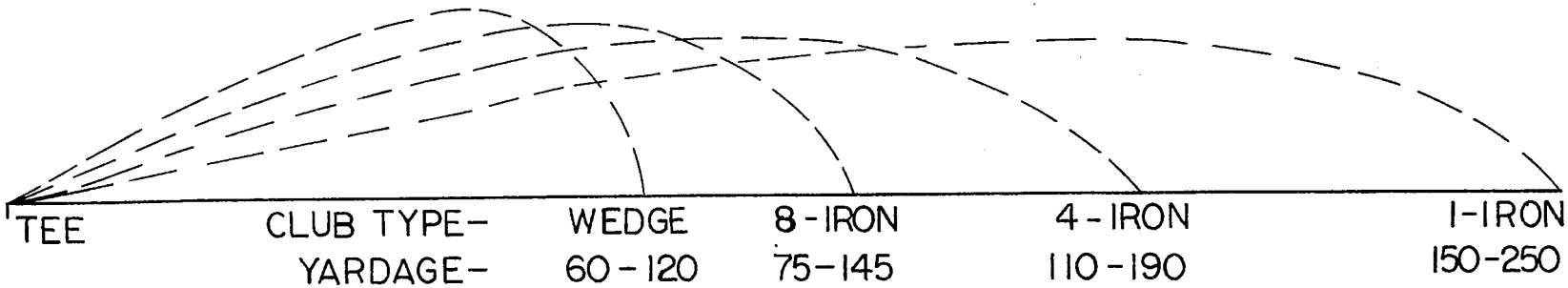
FIG. 12 is a comparable showing of distances traveled by regulation golf balls when hit with conventional golf clubs corresponding to the softgolf clubs mentioned in FIG. 11.

Turning to FIG. 12 it is to be seen that we have set forth yardage obtained utilizing regulation golf equipment rather than softgolf equipment. It is to be noted that the distance is 4 to 5 times as great in this instance, thereby necessitating that considerable area be available, as compared with the softgolf game in accordance with this invention, which can be played in a much smaller area.

Turning to FIG. 13, it is here to be seen that we have presented a form of table in which five typical clubs, ranging from putter to wedge, have been contrasted with regulation clubs of the same designation. It is to be seen in each instance that the loft angle of the softgolf club is the same as the regular golf club; the total length of each corresponding club is the same; and the weight in ounces of each corresponding club is the same. However, there is a marked difference in the area of the club face of the softgolf club when compared with the corresponding regulation club, with the area ratio ranging from $4.2/_1$ for the putter, down to $2.8/_1$ for the wedge. Advantageously, the distance traveled by the softgolf ball when struck by the softgolf club is about one-fourth to one-fifth the distance traveled by the regulation ball that has been struck by the corresponding regulation club, as previously mentioned.

Figure 14:
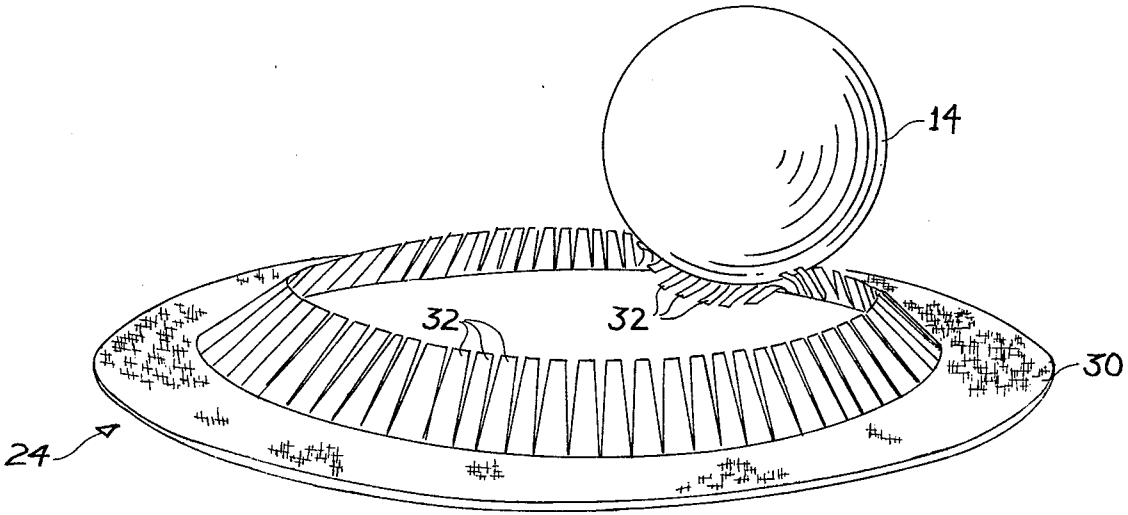
FIG. 14 is a perspective view of a ball trap in accordance with this invention, with a softgolf ball shown entering the trap.
Figure 14A:
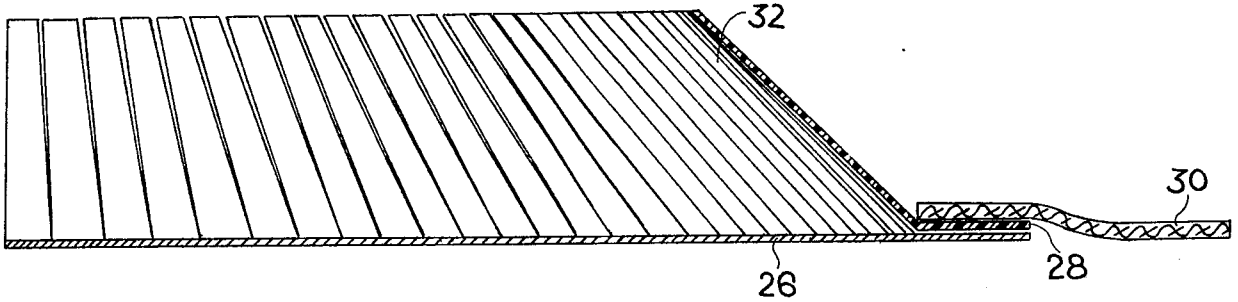
FIG. 14A is a cross-sectional view of the ball trap revealing its internal construction.

Turning to FIG. 14, we have shown an isometric view of a preferred form of portable ball trap for a softgolf ball, the use of which makes possible an impromptu playing of the game of softgolf. This ball trap 24 of course is to allow the golfer to practice his or her putting on a lawn, in a grass park area, athletic field, or even in the livingroom or the family room of a home. As will be noted from this figure and related FIG. 14A, the ball trap 24 entails a base 26, a tine loop 28, and an outer ring 30. The outer ring is of course secured to the base 26 so as to hold the tine loop in a secure position, with this being achieved by the use of stitching, fasteners, adhesive or the like. Holes may be provided in the base 26, enabling placement of a staff, and thus fastening the base to the ground.

The interior portion of the tine loop 28 is cut or otherwise configured to form a comparatively large number of independent inwardly directed tines 32, each tine being approximately 2¼ inches long, and with each tine being bent at approximately a 45° angle to the base of the tine loop. The tines are typically of flexible material, such as rubber, coated or impregnated cloth or paper, or plastic in a non-metallic version of our trap, or of thin metal in a metallic version.

As viewed in FIG. 14, upon a softgolf ball being putted in the direction of the ball trap, it rolls over the outer ring and over certain of the tines, which, because of the thinness of the material used, are quite flexible, which tines give way and allow the ball to pass over in the manner shown in FIG. 4. However, because of the resilient tine construction utilized, as soon as the ball has traveled beyond the tines originally contacted, such tines immediately return to their original position, in which they form approximately a 45° angle with the base.

If the ball has been putted harder than was necessary to merely pass over the tines first contacted, the ball will of course travel across the mid-portion of the base 26 and on to the other side of the ball trap. As long as the ball is traveling at a speed no greater than the limit permitted by the design of the device, upon the ball striking the tines on the opposite side of the device, it will be deflected back in approximately the original direction. This is because the longitudinal rigidity or column strength of the tines encountered on the opposite side of the ball trap is sufficient to arrest the ball in its forward travel and cause it to remain in the trap. We have found that the trap in accordance with this invention is effective for a wide range of ball speeds, although it is of course to be realized that if the ball is traveling at great speed, the trap will no longer be effective, for the ball may tend to jump over the tines at the far side of the trap.

We are of course not to be limited to a portable version of a ball trap, for permanent installations may be utilized. If a hole in the ground or other playing surface is utilized, we prefer for the opening to be approximately of a 10 or 11 inch diameter in order to provide a realistic test of putting skills.

We claim:

1. Apparatus which permits a game of golf to be played in a limited area, approximately one-fifth the length of an average 18 hole golf course, comprising a large golf ball and a set of golf clubs having heads of large size, said ball having a diameter of 4.2 to 5 inches, a weight of 2 to 2½ ounces, and a weight-to-volume ratio between 0.03 and 0.06, each of the clubs of said set of clubs having a head having a weight very similar to that of a regulation golf club, and a face inclined at approximately the angle of the corresponding regulation golf club, each of said faces, however, having a surface area of between 12 and 16 square inches, the relationship between said ball and each of said clubs being such as to permit a form of play action very much like the play action of regulation golf in that a player will be able to utilize an unrestricted swing in hitting said ball and obtain a feel very similar to that received when he swings a regulation golf club and hits a regulation golf ball, the ball, however, traveling for a comparatively short distance because of its small weight-to-volume ratio.

2. The apparatus as defined in claim 1 in which the interior of said ball is largely made up of closed cell lightweight foam material, over which a covering of comparatively tough material is disposed.

3. The apparatus as defined in claim 2 in which the innermost portion of the interior of said ball is hollow.

* * * * *